US006525709B1

(12) United States Patent
O'Callaghan

(10) Patent No.: US 6,525,709 B1
(45) Date of Patent: Feb. 25, 2003

(54) MINIATURE DISPLAY APPARATUS AND METHOD

(75) Inventor: Michael J. O'Callaghan, Louisville, CO (US)

(73) Assignee: Displaytech, Inc., Longmont, CO (US)

( * ) Notice: Subject to any disclaimer, the term of this patent is extended or adjusted under 35 U.S.C. 154(b) by 0 days.

(21) Appl. No.: 08/953,613

(22) Filed: Oct. 17, 1997

(51) Int. Cl.[7] ..... G09G 3/36

(52) U.S. Cl. ..... 345/98; 345/90; 345/92; 345/100

(58) Field of Search ..... 345/147–148, 345/149, 205, 206, 89, 84, 87, 94, 96–100, 104, 102, 90, 92, 207, 690, 691

(56) References Cited

U.S. PATENT DOCUMENTS

| | | | | |
|---|---|---|---|---|
| 4,379,240 A | * | 4/1983 | Mammano | 307/356 |
| 5,404,237 A | * | 4/1995 | Katsuse et al. | 359/56 |
| 5,600,345 A | * | 2/1997 | Dingwall et al. | 345/100 |
| 5,748,164 A | * | 5/1998 | Handschy et al. | 345/89 |
| 5,905,482 A | * | 5/1999 | Hughes et al. | 345/89 |
| 5,959,598 A | * | 9/1999 | McKnight | 345/90 |
| 5,977,940 A | * | 11/1999 | Akiyama et al. | 345/94 |

OTHER PUBLICATIONS

M. A. Handschy and David B. Banas, "Multipurpose Spatial Light Modulator", 1993, Spatial Light Modulators and Applications Technical Digest.

T. J. Drabik and M. A. Handschy, "Silicon VLSI/ferroelectric liquid crystal technology for micropower optoelectronic computing devices", Dec. 10, 1990, Applied Optics.

* cited by examiner

*Primary Examiner*—Richard Hjerpe
*Assistant Examiner*—Henry N. Tran
(74) *Attorney, Agent, or Firm*—Robert G. Crouch; Marsh Fischmann & Breyfogle LLP

(57) ABSTRACT

A display system includes a spatial light modulator having an array of individually controlled pixels switchable between a first and a second state for producing modulated light having gray scale during a given period of time. The system generates a reference signal that varies in a predetermined way during the given period of time. The system also generates analog pixel image signals associated with each of the pixels for the given period of time. The analog pixel image signal representing a desired gray scale level for each associated pixel during the given period of time. Each of the pixels includes an arrangement for receiving the reference signal and an arrangement for receiving the analog pixel image signal associated with that pixel. A comparator within each pixel compares the reference signal and the analog pixel image signal associated with that pixel and outputs a signal for switching the pixel between the first and the second state when the reference signal reaches a predetermined level relative to the analog pixel image signal. In a display system that uses a light modulating medium that requires DC-field balancing, the pixel may further include an inverter arrangement for inverting the output of the comparator for purposes of DC-field balancing.

56 Claims, 3 Drawing Sheets

MINIATURE DISPLAY APPARATUS AND METHOD

GOVERNMENT CONTRACT CLAUSE

This invention was made with Government support under contract F19628-95-C-0185 awarded by the United States Air Force. The Government has certain rights in this invention.

BACKGROUND OF THE INVENTION

The present invention relates generally to methods and arrangements for controlling the operation of pixels in a display system having a certain frame rate. More specifically, the invention relates to using an analog signal to control the switching of binary pixels of a spatial light modulator between their two operating states such that the pixels produce modulated light having gray scale during each frame of the display system.

In the field of display systems and especially those using spatial light modulators having binary pixels that may only be switched between two states (i.e. an ON and an OFF state), it is known that stationary and moving images, either monochrome or color, may be sampled and both color-separated and gray-scale separated pixel by pixel. These pixelated separations may be digitized forming digitized images which correspond to the given images. These digitized images are used by spatial light modulators having binary pixels to create visual images that can be used for a direct visual display, a projected display, a printer device, or for driving other devices that use visual images as their input. One such novel image generator is disclosed in U.S. patent application Ser. No. 08/362,665, now U.S. Pat. No. 5,748,164 entitled ACTIVE MATRIX LIQUID CRYSTAL IMAGE GENERATOR, which application is incorporated herein by reference.

At present, when such binary-pixel spatial light modulators are used in gray-scale display systems, they are controlled by externally provided digital signals. These digital driving methods suffer from several shortcomings. First, in many cases the display input signal is an analog signal. This analog signal must be digitized in order to provide the drive signal needed by the individual pixels. This digitization step may introduce unwanted display system complexity in the form of analog-to-digital converters, frame buffer memories, etc. Further, the transmission of digital video signals requires a high bandwidth communication link to the display. This high bandwidth link may be expensive and may consume excessive electrical power. Second, the techniques used to address binary pixels with externally generated digital control signals (for example, as disclosed in the above-referenced U.S. patent application, Ser. No. 08/362,665) may require pixel switching times that are impractically fast to achieve a finely-gradated gray scale with digital drive of binary pixels. Both of these shortcomings may be overcome by providing methods and arrangements for controlling the switching of binary pixels using an analog signal.

The present invention discloses arrangements and methods for controlling the operation of binary pixels using an analog signal to control the gray scale level of each pixel rather than a sequence of digitized signals.

SUMMARY OF THE INVENTION

As will be described in more detail hereinafter, a method for operating a pixel and a pixel configuration for use in a display system is herein disclosed. A display system including pixels designed in accordance with the invention is also disclosed. The display system includes a spatial light modulator having an array of individually controlled pixels, such as binary pixels, switchable between a first and a second state. The spatial light modulator produces modulated light having gray scale during a given period of time. The pixel includes an arrangement for receiving a reference signal and an arrangement for receiving an analog pixel image signal. The reference signal is a signal that varies in a predetermined way during the given period of time. The analog pixel image signal is a signal representing a desired gray scale level for the pixel during the given period of time. The pixel also includes a comparator for comparing the reference signal and the analog pixel image signal and outputting a signal for switching the pixel between the first and the second state when the reference signal reaches a predetermined level relative to the analog pixel image signal.

In one embodiment, the reference signal is a signal having a voltage that varies in a predetermined way during the given period of time and the analog pixel image signal is a voltage representing the desired gray scale level for the pixel during the given period of time. For example, the voltage of the reference signal may vary linearly throughout the given period of time. In this embodiment, the pixel further includes a storing arrangement, such as a capacitor, for storing the analog pixel image signal voltage.

In another embodiment, the comparing arrangement includes a comparator circuit for outputting a binary output signal. The pixel further includes an inverter arrangement for inverting the output of the comparing arrangement. In a specific version of this embodiment, the pixel includes a liquid crystal light modulating medium that requires DC-field balancing in order to prevent the degradation of the liquid crystal light modulating medium. Also, the reference signal is a signal that varies in a predetermined way and in the same manner during a first and a second equal portion of the given period of time. The pixel further includes an arrangement for activating the inverter arrangement during the second portion of the given period of time. This causes the inverter arrangement to invert the output of the comparing arrangement during the second portion of the given period of time and automatically DC-field balances the liquid crystal light modulating material during the given period of time without requiring the pixel to receive any additional pixel switching data during the given period of time.

BRIEF DESCRIPTION OF THE DRAWINGS

The features of the present invention may best be understood by reference to the following description of the presently preferred embodiments together with the accompanying drawings.

DETAILED DESCRIPTION OF THE PREFERRED EMBODIMENTS

An invention is herein described for providing methods and arrangements for controlling the gray scale level of a binary pixel using an analog signal. In the following description, numerous specific details are set forth in order to provide a thorough understanding of the present invention. However, in view of this description, it will be obvious to one skilled in the art that the present invention may be embodied in a wide variety of specific configurations. In order not to unnecessarily obscure the present invention, known manufacturing processes such as conventional integrated circuit processes will not be described in detail. Also, the various components used to produce a binary pixel spatial light modulator display system other than the novel pixel circuitry will not be described in detail. These components are known to those skilled in the art of binary pixel spatial light modulator display systems.

Figure 1:
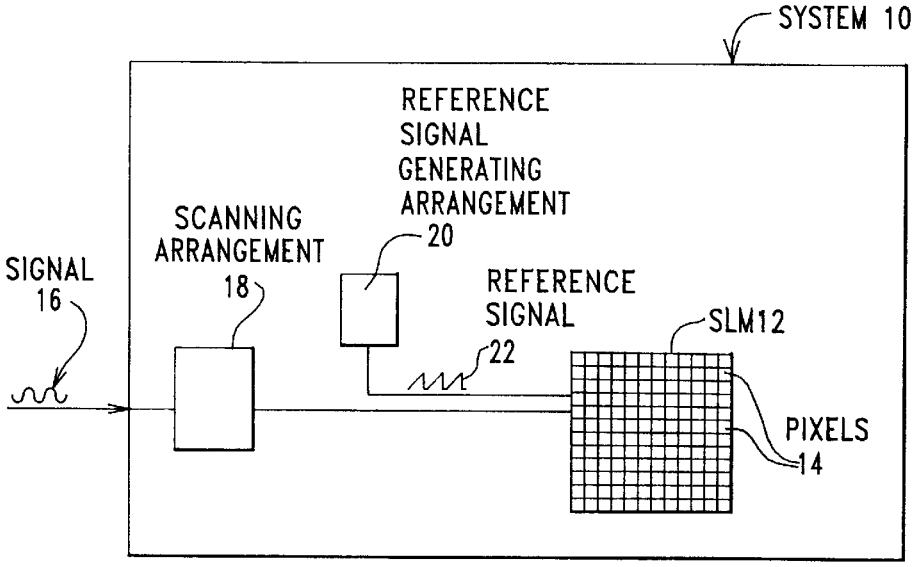
FIG. 1 is a diagrammatic illustration of a first embodiment of a display system designed in accordance with the invention.

Referring initially to FIG. 1, a first embodiment of a display system 10 designed in accordance with the invention will be described. As illustrated in FIG. 1, display system 10 includes a spatial light modulator (SLM) 12 having an array of individually controlled pixels 14. As is well understood by those skilled in the art, images are displayed on the system by using the pixels of the SLM to form a pattern of modulated light. The system is operated by displaying image frames at a certain frame rate in order to produce a viewable image. In the case of a color system, each image frame is typically divided into color subframes for sequentially displaying each of the different color separations of the image. These color subframes are displayed at a rate faster than the critical flicker frequency of the human eye. Therefore, the color subframes of the different colors are integrated by a viewers eye.

In accordance with the invention, system 10 receives a display input signal 16. System 10 also includes scanning arrangement 18 for generating and distributing to each of the pixels 14 an associated pixel image input signal for each frame. Scanning arrangement 18 generates for each pixel 14 a specific pixel image voltage $V_{pix}$ in response to display input signal 16.

This specific pixel image voltage $V_{pix}$ is a voltage that is representative of the gray scale level of the pixel during an associated image frame. In the case of a frame-sequential color display, scanning arrangement 18 would generate three successive image voltages for each pixel during each frame, with each of the image voltages being associated with one of the display colors of the display. For example, in a RGB system which used three color subframes to sequentially display red, green, and blue portions of the image frame, scanning arrangement 18 would generate three pixel image voltages. These three pixel image voltages would be representative of the associated gray scale levels of the red, green, and blue subframes respectively.

Scanning arrangement 18 works in ways that are well known in the art. A typical arrangement is as follows. Pixels 14 of SLM 12 are arranged in a two-dimensional rectangular array addressed by row and column electrodes. When a chosen row is "selected" (all the other rows being "deselected") each pixel in that row receives input from its associated column electrode, while the other pixels connected to a given column do not receive input since their rows are deselected. By scanning through the whole array, selecting one row after the other in turn, each pixel in the array can be addressed with a signal appropriate to it. Thus, when a given row is selected, all the columns are active, and are carrying the signals that make the appropriate inputs for the associated pixels in that row. These multiple column signals are generated from display input signal 16. If display input signal 16 is an analog video signal, each column electrode is driven by the output of a sample and hold amplifier. Each column also has an address decoder whose digital output causes the amplifier to sample input signal 16 when the decoder input matches the column's address, and otherwise to hold. A pixel clock input to system 10 drives a digital counter, the less significant output bits of which provide the inputs to the column address decoders, while the more significant bits of which provide the inputs to row address decoders.

Alternately, input signal 16 could be a digital video signal. Each column circuit then includes a digital to analog converter (DAC) whose output drives the associated column electrode. A similar pixel clock, digital counter, and column address decoders determine when the input signal 16 is latched at the input to each column DAC. The output of the column DAC is hereinafter described as an analog signal, regardless of the fact that it is quantized rather than being continuously variable. As is well known to practitioners of the art, there are many variations on the design of scanning arrangement 18. For the case of digital display input signal 16, scanning arrangement 18 might incorporate fewer DACs than one per column. In this case, the output of each DAC would be multiplexed across several columns, each column having a sample and hold amplifier similar to the case described above with respect to analog display input. Other variations are certainly known. The present invention utilizes pixels having analog inputs. Any arrangement capable of providing each pixel with an appropriate analog input signal (whether the analog pixel input signal is continuously variable or quantized) falls within the scope of the invention.

Still referring to FIG. 1, system 10 further includes a reference signal generating arrangement 20 for generating a reference signal indicated by reference numeral 22. Reference signal 22 is a global signal that is common to, and simultaneously used by, all of the pixels. Reference signal 22 may take on a wide variety of signal forms depending on the requirements of the specific application. In one embodiment, reference signal 22 is a saw tooth shaped signal as illustrate in FIG. 2A. In this embodiment, a voltage, $V_{ref}$, of reference signal 22 varies linearly during each frame of the display system. In the case of a color display using three color subframes, the sawtooth shape would be repeated three times for each frame such that each sawtooth corresponded to and associated one of the color subframes. Although the reference signal has been described as a sawtooth shaped voltage signal that varies linearly over time, this is not a requirement. Instead, the reference signal may be varied in a wide variety of ways and still remain within the scope of the invention. For example, the voltage may vary exponentially over time or may vary according to any other function of time. Also, although the reference signal has been described as being a voltage that varies in a predetermined way, it should be understood that the reference signal may take the form of a signal that has a current or other attribute that varies in a predetermined way. Any of these variations would fall within the scope of the invention so long as the reference signal varied in some predetermined way during the frame time.

Figure 3:
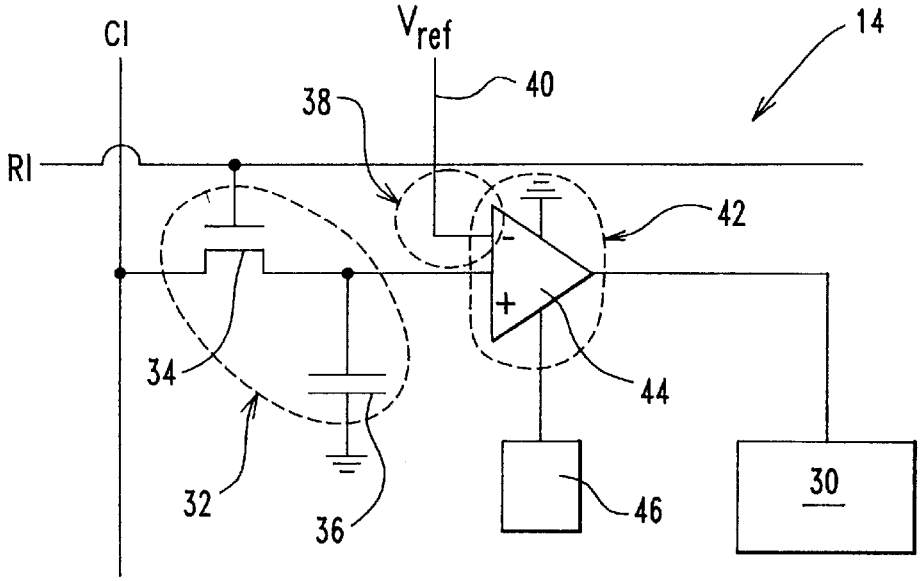
FIG. 3 is a diagrammatic illustration of a first embodiment of a pixel designed in accordance with the invention.

Now that the general configuration of the system has been described, a first embodiment of pixel 14 designed in accordance with the invention will be described. As shown in FIG. 3, pixel 14 includes a pixel electrode 30 which is used to switch the pixel between two binary states (i.e. ON and OFF). Pixel electrode 30 may take a wide variety of forms depending upon the specific type of pixel that is being used. In the case of a ferroelectric liquid crystal (FLC) system as described in the above referenced patent application, the pixel electrode for each pixel would be a metallized reflective electrode formed on top of an integrated circuit. Alternatively, the pixel electrode may electrostatically control the tilt of a miniature mirror, or the displacement of a miniature diffraction grating, either of which is used for the light modulating element of each pixel. Although only two specific examples of the configuration of the pixel electrode and the pixel light modulating method are given, it should be understood that the present invention is not limited to these examples. Instead, the invention would equally apply regardless of the specific configuration of the pixel electrode and regardless of the light modulating method used so long as the pixel is capable of operating in a binary manner.

As shown in FIG. 3, pixel 14 includes a row input line indicated by the reference numeral R1 and a column input line indicated by reference numeral C1. In this embodiment, row input line RI and column input line C1 are used to input the pixel image voltage $V_{pix}$. In accordance with one aspect of the invention, pixel 14 further includes a first receiving arrangement 32 for receiving and storing the pixel image voltage $V_{pix}$ that is associated with the pixel. In the embodiment shown in FIG. 3, first receiving arrangement 32 includes a transistor 34 and a capacitor 36. Transistor 34 is electrically connected between row input R1, column input C1, and capacitor 36 such that when row input R1 is selected, column input C1 is able to provide pixel image voltage $V_{pix}$ to capacitor 36. Therefore, pixel image voltage $V_{pix}$ is stored within capacitor 36 when row input line R1 is selected. Although only one specific configuration for first receiving arrangement 32 is described, it should be understood that this arrangement may take a wide variety of forms and still remain within the scope of the invention so long as the receiving arrangement is capable of receiving and using the analog pixel image signal associated with the pixel.

Pixel 14 also includes a second receiving arrangement 38 for receiving reference signal 22. As mentioned above, all of the pixels simultaneously receive reference signal 22. In the embodiment illustrated in FIG. 3, second receiving arrangement 38 consists of a reference signal input line 40 coming into pixel 14. As described above, reference signal 22 has a voltage $V_{ref}$ that varies in a predetermined way during each image frame of the display system. Again, although only one specific example of second receiving arrangement 38 has been described, this arrangement may take any form so long as the pixel is able to receive reference signal 22.

Still referring to FIG. 3 and in accordance with the invention, pixel 14 also includes a comparing arrangement 42. Comparing arrangement 42 is configured to take as its inputs pixel image voltage $V_{pix}$ from first receiving arrangement 32 and reference signal 22 from second receiving arrangement 38. Comparing arrangement 42 compares the voltages of pixel image voltage $V_{pix}$ and reference signal $V_{ref}$ and outputs a signal for switching pixel 14 between its binary states when the voltage of reference signal 22 reaches a predetermined voltage relative to pixel image voltage $V_{pix}$.

Comparing arrangement 42 may take on a wide variety of specific configurations. Any conventional comparator or comparator circuitry may be used so long as pixel image voltage $V_{pix}$ is compared with reference signal 22 and the output of the circuit causes the pixel to switch states when reference signal 22 reaches a predetermined voltage relative to pixel image voltage $V_{pix}$. Suitable and readily providable comparators and comparator circuits are well known in the electronic circuitry art. Many of these circuits include features such as auto zeroing or other features which improve the accuracy at which the comparator or comparator circuitry trigger the switching of the pixel state. The present invention would equally apply to all of these various known comparators and comparator circuits.

Figure 2A:
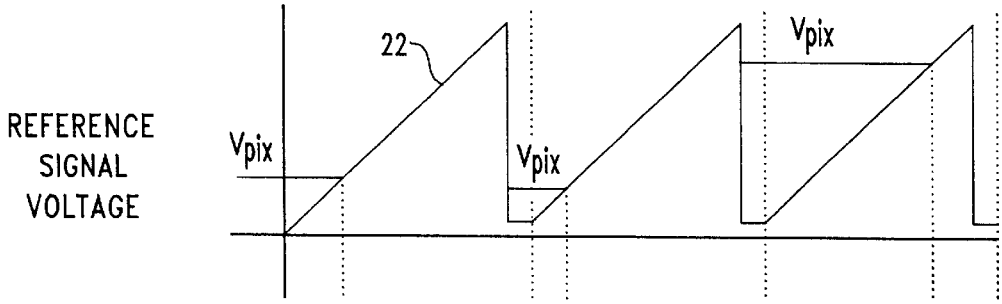
FIG. 2A is a graph illustrating one embodiment of a reference signal used by the system of FIG. 1.
Figure 2B:
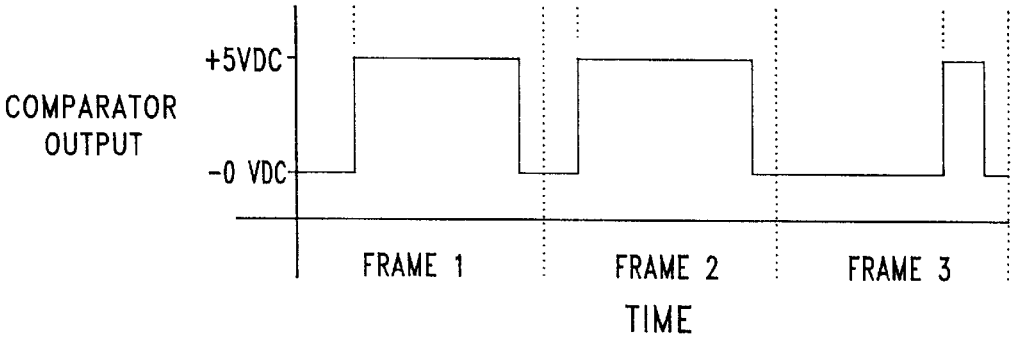
FIG. 2B is a graph illustrating the switching of a pixel using the reference signal of FIG. 2A.

In the embodiment illustrated in FIG. 3, comparing arrangement 42 takes the form of a comparator 44. Comparator 44 takes as its input reference signal 22 provided by input line 40. Capacitor 36 is also electrically connected to comparator 44 such that comparator 44 uses the pixel image voltage $V_{pix}$ as another input. Comparator 44 is also electrically connected to a power source 46 which provides a voltage that is used to switch the state of pixel electrode 30. In this embodiment, pixel 14 is an FLC liquid crystal pixel that is switched between its two different states by applying to electrode 30 either 5 VDC for its first state or 0 VDC for its second state. Electrode 30 forms part of an overall pixel capacitor which applies the output of the comparator and causes the FLC material to switch and remain in either the first or second state depending on whether 5 VDC or 0 VDC is applied. If it is desired that the voltages applied to switch the pixel between the first and second states have opposite polarities, as is the case for ferroelectric liquid crystal light modulators, this can be accomplished by biasing a window electrode that is common to all of the pixels to a voltage between 5 VDC and 0 VDC (e. g. 2.5 VDC). Power source 46 provides comparator 44 with the 5 VDC and 0 VDC. Comparator 44 switches its output between 5 VDC and 0 VDC depending on the relative voltages of reference signal 22 and pixel image voltage $V_{pix}$. In this example, comparator 44 outputs 0 VDC when the voltage of reference signal 22 is less than pixel image voltage $V_{pix}$ . However, when the voltage of reference signal 22 increases to a voltage that is equal to $V_{pix}$, comparator 44 switches its output to 5 VDC until the voltage of reference signal 22 drops below $V_{pix}$. This is illustrated in FIG. 2B.

Now that the structure of system 10 and pixel 14 have been described, the operation of the system will be described. As mentioned above, system 10 receives display input signal 16 as illustrated in FIG. 1. Scanning arrangement 18 uses display input signal 16 to generate pixel image voltages $V_{pix}$ for each of the pixels during each image frame of the system. In the case of a color system, scanning arrangement 18 would generate a pixel image voltage for each of the pixels during each color subframe of the system. Simultaneously, reference signal generating arrangement 20 generates a reference signal 22 that varies in a predetermined way during each image frame.

Each pixel 14 receives and stores its own individual analog pixel image voltage $V_{pix}$ using first receiving arrangement 32. Each pixel 14 also receives global reference signal 22 using second receiving arrangement 38. For each pixel, comparing arrangement 42 within each pixel 14 compares the voltage of reference signal 22 to the voltage of the stored pixel image voltage. When the reference signal reaches a predetermined voltage relative to the pixel image voltage, comparing arrangement 42 outputs a signal that causes pixel 14 to switch states.

In the specific embodiments described, pixel image voltage $V_{pix}$ is stored in capacitor 36. Comparator 44 compares this pixel image voltage stored in capacitor 36 to the reference signal voltage 22 and switches the state of pixel 14 (i.e. from the OFF state to the ON state) when the voltage of the reference signal is equal to the pixel image voltage. As described above for this embodiment, reference signal 22 varies linearly over time during the image frame time as illustrated in FIG. 2A. Therefore, the portion of the time making up the image frame time that pixel 14 is switched to its ON state depends upon the voltage of pixel image voltage $V_{pix}$. As illustrated in FIG. 2B, since the voltage of the reference signal varies linearly over the image frame time, this approach allows the pixel to be switched ON for any desired portion of the frame time by storing the appropriate pixel image voltage $V_{pix}$ in capacitor 36. Therefore, the viewer perceives a gray scale level for pixel 14 during each frame that is proportional to the length of time that the pixel is switched ON during each frame time. This is because the image frames are presented to a viewer at a rate that is faster than the critical flicker frequency of the human eye which causes the eye to intergrate the ON portion of the frame time with the OFF portion of the frame time. This integration causes the pixel to appear to have a gray scale level that is proportional to the portion of time the pixel is ON during each frame.

Because the reference signal may be varied continuously throughout the frame time, this approach is capable of providing a very large number of gray scale levels. Also, since this approach uses a single input pixel image voltage for each pixel for each frame, the bandwidth needed to provide input to the pixel in order to achieve this large number of gray scale levels is substantially less than would be required if the gray scale levels were digitized as described briefly in the background and as described in detail in the above referenced patent application.

When an FLC spatial light modulator is used as the SLM for a display system, there is an additional concern that must be taken into account. FLC materials used to make FLC spatial light modulators may degrade over time if the FLC material is exposed to an unbalanced electric field. This phenomenon and methods of solving the problems associated with it are described in detail in copending U.S. patent application Ser. No. 08/361,775, filed Dec. 22, 1994, abandoned May 29, 1998 entitled DC FIELD-BALANCING TECHNIQUE FOR AN ACTIVE MATRIX LIQUID CRYSTAL IMAGE GENERATOR, which is incorporated herein by reference. In one approach to solving the electric field balancing problem on a binary pixel SLM, the pixels of the SLM are switched to their opposite states using voltages of the same magnitude but opposite sign. For example, the pixel may be switched to its ON or first state by applying 5 VDC to the pixel electrode and switched to its OFF or second state by applying 0 VDC to the pixel electrode. As mentioned above, a window electrode that is common to all of the pixels may be biased to a voltage between 5 VDC and 0 VDC, in this case 2.5 VDC. This causes the electric field formed through the pixel during the ON and OFF states to be of equal magnitude but opposite polarity. If this is the case, the electric field may be balanced by simply inverting the states of each of the pixels for each frame such that the pixel is always in the ON state for the same amount of time that it is in the OFF state. In order to facilitate this possible requirement, the pixels of the present invention may further include an inverter arrangement for inverting the output of the comparing arrangement.

Figure 4:
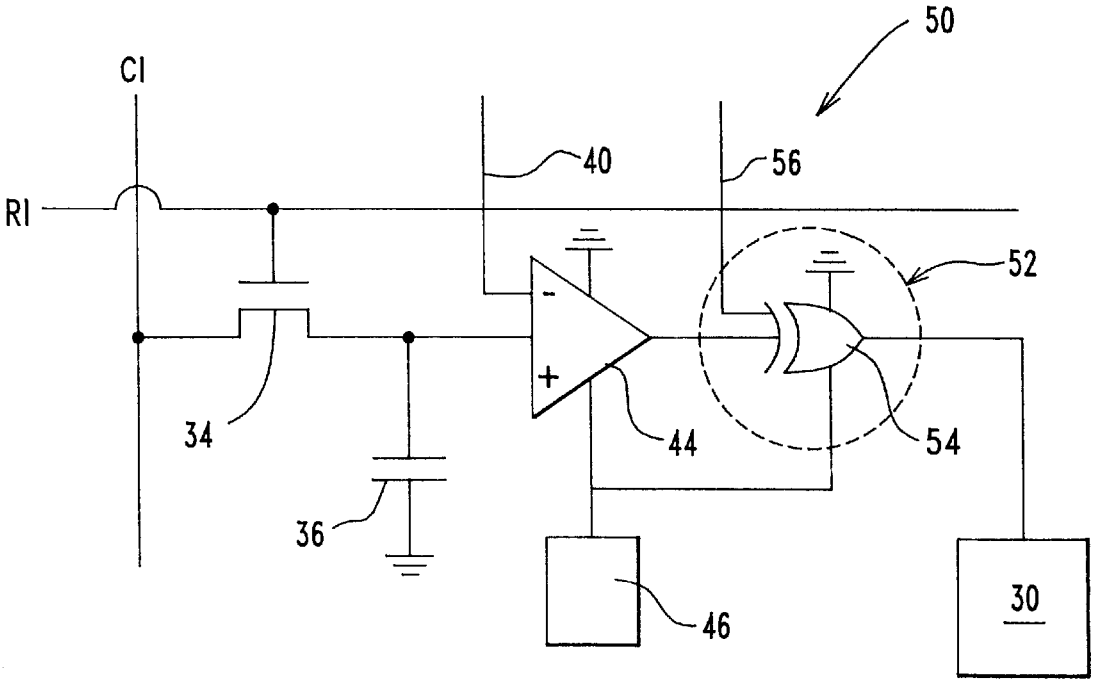
FIG. 4 is a diagrammatic illustration of a second embodiment of a pixel designed in accordance with the invention.

Referring now to FIG. 4, a second embodiment of a pixel 50 designed in accordance with the invention will be described. As shown in FIG. 4, pixel 50 is identical to pixel 14 described above except that pixel 50 includes an inverter arrangement 52. As described in detail above for pixel 14, pixel 50 includes column input line C1, row input line R1, reference signal input line 40, transistor 34, capacitor 36, pixel electrode 30, and comparator 44. Pixel 50 operates in the same manner as pixel 14. However, in this embodiment, pixel 50 further includes inverter arrangement 52 electrically connected between comparator 44 and pixel electrode 30. Inverter arrangement 52 may be used to selectively invert the output signal from comparator 44 when an externally generated invert signal (i.e., control signal) indicates for inverter arrangement 52 to invert the output signal of comparator 44.

In the embodiment shown in FIG. 4, inverter arrangement 52 includes an inverter 54 and an invert input line 56 for providing an invert signal to inverter 54. Although inverter arrangement 52 is described as including inverter 54 and invert input line 56, inverter arrangement 52 may take on a wide variety of specific configurations. Any conventional inverter or inverter circuitry may be used so long as it is able to reverse the output from comparator 44. The desired selectable inverter has the same logical function as an exclusive OR (XOR) gate, and may be so implemented. Other suitable and readily providable inverters and inverter circuits are well known in the electronic circuitry art. The present invention would equally apply to all of these various inverters and inverter circuits.

As mentioned above, pixel 50 would operate in the same manner as pixel 14 except that inverter arrangement 52 may be used to invert the output of comparator 44 when desired. For example, when invert input line 56 is not selected, inverter arrangement 52 would have no affect on the operation of the pixel. However, when invert input line 56 is selected, inverter 54 would cause the output signal from comparator 44 to be reversed. In the embodiment shown, inverter 54 takes as its inputs the output from comparator 44 and the signal from invert input line 56. Inverter 54 is also electrically connected to power source 46 such that power source 46 provides inverter 54 with 5 VDC and 0 VDC. With this configuration, when inverter 54 receives an invert signal through invert input line 56, inverter 54 detects whether the output from comparator 44 is 5 VDC or 0 VDC. Inverter 54 then uses power source 46 to output the opposite voltage relative to the output from comparator 44.

The selectable inverter provides a very important improvement to the pixel function. In the case of the pixel previously described with reference to FIG. 3, providing the needed DC balancing requires writing two different values of the pixel image input signal to the pixel on two subsequent frames. A first input is provided, which causes the pixel to be ON for some fraction f of the frame time, and then a second input is provided on the next frame which causes the pixel to be ON for a fraction (1−f) of the frame, thereby ensuring DC balance. With the pixel of FIG. 4, only one input need be provided.

Figure 5:
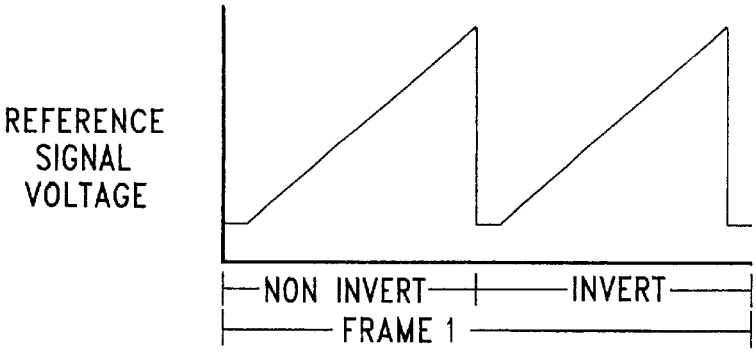
FIG. 5 is a graph illustrating one embodiment of a reference signal used by the system of FIG. 4.

FIG. 5 illustrates one embodiment of how the reference signal $V_{ref}$ may be cycled twice during each frame in order to allow pixel 60 to provide the DC balancing function without requiring the pixel to be addressed with a pixel image signal voltage twice. As illustrated in FIG. 5, reference signal 22 is cycled twice during each frame such that reference signal 22 varies in a predetermined way that is repeated for a first and a second equal portion of each frame. On the first cycle of the reference signal which occurs during the first equal portion of the frame time, the selectable inverter is programmed not to invert. As described above, this causes the pixel to be in its ON state for a fraction f of the first equal portion of the frame time as determined by the stored pixel image voltage $V_{pix}$ stored in capacitor 36. Without providing any new input, the reference signal is cycled a second time with the selectable inverter now programmed to invert as shown in FIG. 5. This causes the pixel to be OFF for a fraction f of the second equal portion of the frame time, again as determined by the same pixel image voltage $V_{pix}$ still stored in capacitor 36. Hence, the pixel is its ON state for a fraction (1−f) of the second equal portion of the frame time. In this way, DC field balance can be achieved without the need for addressing the pixel twice, thereby conserving bandwidth and power consumption.

Figure 6:
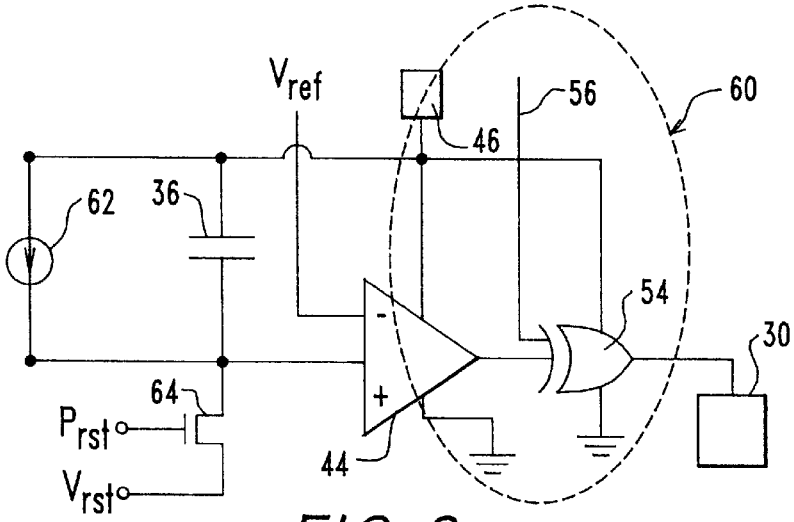
FIG. 6 is a diagrammatic illustration of a third embodiment of a pixel designed in accordance with the invention.

Although the embodiments of FIGS. 3 and 4 are described as including row and column input lines and a reference signal input line, this is not a requirement. Instead, any arrangement may be used to provide these signals to the pixel. For example, as an alternative to row/column addressing as the way of providing input signals to pixels in an array, each input can be provided from a photodetector located in each pixel. FIG. 6 shows an embodiment of a pixel 60 that includes photodetector inputs.

As illustrated in FIG. 6, pixel 60 includes pixel electrode 30, capacitor 36 comparator 44, power source 46, and inverter 54 as described above. However, instead of row and column inputs, pixel 60 includes a photodetector 62 connected to capacitor 36 and a transistor 64 for resetting capacitor 36. Photodetector may be, for example, a photodiode or a phototransistor. Photodetector 62 converts incident light intensity into a photocurrent. At the beginning of a frame, transistor 64 is momentarily made to conduct by pulsing a signal $P_{rst}$ which is a signal that is common to all pixels in the array. $P_{rst}$ is pulsed high, thereby causing capacitor 36 to be charged to a reset voltage $V_{rst}$. After transistor 64 stops conducting, the magnitude of the photocurrent from photodetector 62 then determines the evolution of the voltage on capacitor 36 which is in turn used to control the switching of pixel electrode 30 in the same manner as described above for pixel 50 of FIG. 4.

Figure 7:
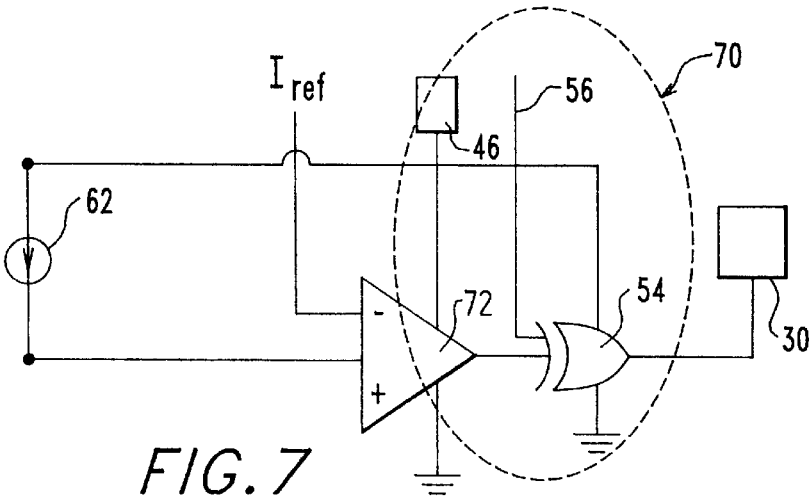
FIG. 7 is a diagrammatic illustration of a fourth embodiment of a pixel designed in accordance with the invention.

Although the pixel image signals have been described above as being a voltage and the reference signal has been described as a voltage that varies in a predetermined way during the frame time, this is not a requirement of the invention. Instead, these signals may take any specific form so long as the pixel image signal represents the desired gray scale for the pixel and the reference signal varies in a predetermined way during the frame time. For example, these signals may take the form of currents rather than voltages. FIG. 7 illustrates a pixel 70 that uses currents rather than voltages for these signals.

As illustrated in FIG. 7, pixel 70 includes pixel electrode 30, power source 46, inverter 54, and photodetector 62 as described above for FIG. 6. However, pixel 70 includes a comparator 72 that takes as its inputs a reference signal and the output of photodetector 62. In this embodiment, reference signal is a current that varies in a predetermined way during each frame time. Comparator 72 compares the current of reference signal to the current produced by photodetector 62 and outputs a signal for switching pixel electrode 30 in the same manner as describe above for the other embodiments except that comparator 72 compares currents rather than voltages.

Although pixels 14 and 50 have been described as using 5 VDC and 0 VDC for switching the pixel electrode, this is not a requirement. Instead, any appropriate voltages may be used to switch the pixel between its binary states. Also, although the pixels have been described as using FLC material as the light modulating material of the system, this is not a requirement. Instead, the present invention would equally apply to a wide variety of systems that use spatial light modulators having binary switched pixels.

Although only a few embodiments of a display system and pixels in accordance with the invention have been described in detail, it should be understood that the present invention may take on a wide variety of specific configurations and still remain within the scope of the present invention. Therefore, the present examples are to be considered as illustrative and not restrictive, and the invention is not to be limited to the details given herein, but may be modified within the scope of the appended claims.

What is claimed is:

1. A display system comprising:

(a) a spatial light modulator having an array of individually controlled pixels, each of which pixels includes a light modulating medium having a first light modulating state in response to a first electric field applied across the light modulating medium and a second light modulating state in response to a second electric field applied across the light modulating medium, said second light modulating state having a different optical response from the optical response of said first light modulating state, for producing modulated light having gray scale during a given period of time;

(b) reference signal generating means for generating a reference signal that varies in a predetermined way during said given period of time; and (c) analog pixel image signal generating means for generating analog pixel image signals associated with each of said pixels for said given period of time, the analog pixel image signal being a signal representing a desired gray scale level for said pixel during said given period of time, each of said pixels including (i) means for receiving said reference signal, (ii) means for receiving said analog pixel image signal, and (iii) comparing means for comparing said reference signal and said analog pixel image signal and outputting a signal for switching said light modulating medium between said first and second light modulating states when said reference signal reaches a predetermined level relative to said analog pixel image signal.

2. A display system according to claim 1 wherein said pixels are binary pixels.

3. A display system according to claim 1 wherein said reference signal is signal having a voltage that varies in a predetermined way during said given period of time.

4. A display system according to claim 3 wherein said voltage of said reference signal varies non-linearly throughout said given period of time.

5. A display system according to claim 3 wherein said voltage of said reference signal varies linearly throughout said given period of time.

6. A display system according to claim 1 wherein said analog pixel image signal is a voltage representing said desired gray scale level for said pixel during said given period of time.

7. A display system according to claim 6 wherein each of said pixels further includes storing means for storing said analog pixel image signal voltage.

8. A display system according to claim 7 wherein said storing means includes a capacitor.

9. A display system according to claim 1 wherein said comparing means includes a comparator circuit for outputting a binary output signal.

10. A display system according to claim 1 wherein said means for receiving said reference signal for all of said pixels are configured to simultaneously receive said reference signal.

11. A display system according to claim 1 wherein said first and second electric fields are substantially identical in magnitude but of opposite polarity.

12. A display system according to claim 1 wherein said spatial light modulator includes a window electrode positioned across said array of individually controlled pixels and a substantially constant voltage supplied to said window electrode, and each of said pixels further includes a pixel electrode, said pixel electrode cooperating with said window electrode to produce said first electric field and said second electric field, one at a time, therebetween and across said light modulating medium in accordance with the signal outputted by said comparing means so as to switch said light modulating medium between said first and second light modulating states.

13. A display system according to claim 1 wherein only said first and second electric fields are applied, one at a time, across the light modulating medium.

14. A display system comprising:

(a) a spatial light modulator having an array of individually controlled pixels, each pixel of which includes a light modulating medium having a first light modulating state in response to a first electric field applied across the light modulating medium and a second light modulating state in response to a second electric field applied across the light modulating medium, said second light modulating state having a different optical response from the optical response of said first light modulating state, for producing modulated light having gray scale during a given period of time;

(b) reference signal generating means for generating a reference signal that varies in a predetermined way during said given period of time;

(c) analog pixel image signal generating means for generating analog pixel image signals associated with each of said pixels for said given period of time, the analog pixel image signal being a signal representing a desired gray scale level for said pixel during said given period of time, each of said pixels including (i) means for receiving said reference signal, (ii) means for receiving said analog pixel image signal, and (iii) comparing means for comparing said reference signal and said analog pixel image signal and outputting a signal for switching said light modulating medium between said first and said second light modulating states when said reference signal reaches a predetermined level relative to said analog pixel image signal, said pixels further including inverter means for inverting the signal output by said comparing means.

15. A display system according to claim 14 wherein:

said reference signal is a signal that varies in a predetermined way and in the same manner during a first and a second equal portion of said given period of time; and each of said pixels further includes means for activating said inverter means during said second portion of said given period of time thereby causing said inverter means to invert said output of said comparing means during said second portion of said given period of time and automatically DC-field balancing said light modulating medium during said given period of time without requiring said pixels to receive any additional pixel switching data during said given period of time.

16. A display system according to claim 15 wherein said light modulating medium requires DC-field balancing in order to prevent degradation of the light modulating medium.

17. A display system according to claim 15 wherein each pixel of said array of individually controlled pixels further includes illumination means, said illumination means including a source of light having an ON operating state during which light is directed into the light modulating medium of that pixel and an OFF operating state during which no light from said illumination means reaches the light modulating medium of that pixel, said illumination means cooperating with said means for activating said inverter means in such a way that said source of light is maintained in its ON operating state during said first portion of said given time and the source of light is maintained in its OFF operating state during said second portion of said given time so as to produce modulated light having gray scale during said given period of time while, at the same time, DC-field balancing said light modulating medium.

18. A method of displaying a gray scale optical image within a given frame time on a display, the display including an array of individually controlled pixels, each of which pixels includes a light modulating medium having a first light modulating state in response to a first electric field applied across the light modulating medium and a second light modulating state in response to a second electric field applied across the light modulating medium, said first and second electric fields being substantially identical in magnitude but of opposite polarity and said second light modulating state having a different optical response from the optical response of said first light modulating state, said method comprising;

(a) providing a reference signal that varies in a predetermined way during said given frame time;

(b) providing to each pixel an analog pixel image signal that is associated with each pixel for said given frame time, the analog pixel image signal being a signal representing a desired gray scale level for each associated pixel during said given frame time; and (c) for each of said pixels, comparing said analog pixel image signal to said reference signal and switching said light modulating medium between said first and second light modulating states when said reference signal reaches a predetermined level relative to said analog pixel image signal associated with each pixel.

19. A method according to claim 18 wherein the method further includes the step of resetting each of said pixels to its first optical output state at the beginning of said given frame time and wherein the step of comparing said analog pixel image signal to said reference signal and switching each of said light modulating medium between said first and second light modulating states includes the step of switching said light modulating medium to its second light modulating state when said reference signal reaches a predetermined level relative to said analog pixel image signal associated with each pixel.

20. A method according to claim 18 wherein said pixels are binary pixels.

21. A method according to claim 18 wherein the step of providing a reference signal includes the step of providing a reference signal having a voltage that varies in a predetermined way during said given frame time.

22. A method according to claim 21 wherein said voltage of said reference signal varies linearly throughout said given frame time.

23. A method according to claim 18 wherein said step of providing an analog pixel image signal to each individual pixel includes the step of providing an analog pixel image signal to each individual pixel with the analog pixel image signal being a voltage representing said desired gray scale level for each pixel during said given frame time.

24. A method according to claim 23 wherein the method further includes the step of storing said analog pixel image signal voltage associated with each individual pixel.

25. A method according to claim 24 wherein said step of storing said analog pixel image signal voltage associated with each individual pixel includes the step of storing the analog pixel image signal voltage in a capacitor associated with each individual pixel.

26. A method according to claim 18 wherein said step of comparing said analog pixel image signal to said reference signal and switching said light modulating medium between said first and second light modulating states includes the step of using a comparator circuit associated with each pixel to compare said reference signal to said analog pixel image signal associated with each pixel and output an output signal for switching each of said pixels between said first and second light modulating states.

27. A method according to claim 18 wherein all of said pixels are operated such that all of said pixels simultaneously receive said reference signal.

28. A method according to claim 18 wherein said display further includes a window electrode positioned across said array of individually controlled pixels and each of said pixels further includes a pixel electrode, which pixel electrode cooperating with said window electrode to produce said first electric field or said second electric field, one at a time, therebetween and across said light modulating medium, and wherein said step of comparing said analog pixel image signal to said reference signal and switching said light modulating medium between said first and second light modulating states includes the steps of:

supplying a substantially constant voltage to said window electrode; and at each of said pixels, providing an output signal to said pixel electrode when said reference signal reaches a predetermined level relative to said analog pixel image signal associated with that pixel so as to switch said light modulating medium between said first and second light modulating states.

29. A method according to claim 18 wherein said step of comparing said analog pixel image signal to said reference signal and switching said light modulating medium between said first and second light modulating states includes the step of applying only said first and second electric fields, one at a time, across said light modulating medium.

30. A method of displaying a gray scale optical image within a given frame time on a display, the display including an array of individually controlled pixels, each of which pixels includes a light modulating medium having a first light modulating state in response to a first electric field applied across the light modulating medium and a second light modulating state in response to a second electric field applied across the light modulating medium, said first and second electric fields being substantially identical in magnitude but of opposite polarity and said second light modulating state having a different optical response from the optical response of said first light modulating state, said method comprising:

(a) providing a reference signal that varies in a predetermined way during said given frame time;

(b) providing to each pixel an analog pixel image signal that is associated with each pixel for said given frame time, the analog pixel image signal being a signal representing a desired gray scale level for each associated pixel during said given frame time;

(c) for each of said pixels, comparing said analog pixel image signal to said reference signal using a comparator circuit associated with each individual pixel and switching said light modulating medium between said first and second light modulating states when said reference signal reaches a predetermined level relative to said analog pixel image signal associated with each pixel; and (d) inverting said output signal of said comparator circuit during certain portions of said frame time.

31. A method according to claim 30 wherein:

said step of providing a reference signal includes the step of providing a reference signal that varies in a predetermined way and in the same manner during a first and a second equal portion of said given frame time; and the step of inverting said output signal of said comparator circuit includes the step of inverting said output signal of the comparator circuit during said second portion of said given frame time thereby inverting the light modulating states of said pixels during said second portion of said given frame time relative to the light modulating states of said pixel during the first portion of said given frame time and automatically DC-field balancing said light modulating medium during said given frame time without requiring said pixels to receive any additional pixel switching data during said given frame time.

32. A method according to claim 31 wherein said light modulating medium requires DC-field balancing in order to prevent degradation of the light modulating medium.

33. A method according to claim 31 further comprising the steps of:

providing illumination means at each pixel, said illumination means including a source of light having an ON operating state during which light is directed into the light modulating medium of that pixel and an OFF operating state during which no light from said illumination means reaches the light modulating medium of that pixel;

maintaining said source of light in its ON operating state during said first portion of said given frame time; and maintaining said source of light in its OFF operating state during said second portion of said given frame time so as to produce modulated light having gray scale during said given frame time while, at the same, DC-field balancing said light modulating medium.

34. In a display system including a spatial light modulator having an array of individually controlled pixels, each of which pixels includes a light modulating medium having a first light modulating state in response to a first electric field applied across the light modulating medium and a second light modulating state in response to a second electric field applied across the light modulating medium, said second light modulating state having a different optical response from the optical response of said first light modulating state, for producing modulated light having gray scale during a given period of time, a pixel comprising:

(a) means for receiving a reference signal that varies in a predetermined way during said given period of time;

(b) means for receiving an analog pixel image signal, the analog pixel image signal being a signal representing a desired gray scale level for said pixel during said given period of time; and (c) comparing means for comparing said reference signal and said analog pixel image signal and outputting a signal for switching said light modulating medium between said first and said second light modulating states when said reference signal reaches a predetermined level relative to said analog pixel image signal.

35. A pixel according to claim 34 wherein said pixel is a binary pixel.

36. A pixel according to claim 34 wherein said reference signal is signal having a voltage that varies in a predetermined way during said given period of time.

37. A pixel according to claim 36 wherein said voltage of said reference signal varies linearly throughout said given period of time.

38. A pixel according to claim 34 wherein said analog pixel image signal is a voltage representing said desired gray scale level for said pixel during said given period of time.

39. A pixel according to claim 38 wherein said pixel further includes storing means for storing said analog pixel image signal voltage.

40. A pixel according to claim 39 wherein said storing means includes a capacitor.

41. A pixel according to claim 34 wherein said comparing means includes a comparator circuit for outputting a binary output signal.

42. A display system according to claim 34 wherein only said first and second electric fields are applied, one at a time, across the light modulating medium.

43. A pixel according to claim 34 wherein said spatial light modulator includes a window electrode positioned across said array of individually controlled pixels and a substantially constant voltage supplied to said window electrode, and each of said pixels further includes a pixel electrode, said pixel electrode cooperating with said window electrode to produce said first electric field and said second electric field, one at a time, therebetween and across said light modulating medium in accordance with the signal outputted by said comparing means so as to switch said light modulating medium between said first and second light modulating states.

44. A pixel according to claim 34 wherein said first and second electric fields are substantially identical in magnitude but of opposite polarity.

45. In a display system including a spatial light modulator having an array of individually controlled pixels, each of which pixels includes a light modulating medium having a first light modulating state in response to a first electric field applied across the light modulating medium and a second light modulating state in response to a second electric field applied across the light modulating medium, said second light modulating state having a different optical response from the optical response of said first light modulating state, for producing modulated light having gray scale during a given period of time, a pixel comprising:

(a) means for receiving a reference signal that varies in a predetermined way during said given period of time;

(b) means for receiving an analog pixel image signal, the analog pixel image signal being a signal representing a desired gray scale level for said pixel during said given period of time; and (c) comparing means for comparing said reference signal and said analog pixel image signal and outputting a signal for switching said light modulating medium between said first and said second light modulating states when said reference signal reaches a predetermined level relative to said analog pixel image signal, said pixel further including inverter means for inverting said signal output by said comparing means.

46. A pixel according to claim 45 wherein:

said reference signal is a signal that varies in a predetermined way and in the same manner during a first and a second equal portion of said given period of time; and said pixel further includes means for activating said inverter means during said second portion of said given period of time thereby causing said inverter means to invert said signal output by said comparing means during said second portion of said given period of time and automatically DC-field balancing said light modulating medium during said given period of time without requiring said pixel to receive any additional pixel switching data during said given period of time.

47. A pixel according to claim 46 wherein said light modulating medium requires DC-field balancing in order to prevent degradation of the light modulating medium.

48. A pixel according to claim 46 wherein each pixel of said array of individually controlled pixels further includes illumination means, said illumination means including a source of light having an ON operating state during which light is directed into the light modulating medium of that pixel and an OFF operating state during which no light from said illumination means reaches the light modulating medium of that pixel, said illumination means cooperating with said means for activating said inverter means in such a way that said source of light is maintained in its ON operating state during said first portion of said given period of time and the source of light is maintained in its OFF operating state during said second portion of said given period of time so as to produce modulated light having gray scale during said given period of time while, at the same time, DC-field balancing said light modulating medium.

49. In a display system including a spatial light modulator having an array of individually controlled pixels, each of which pixels includes a light modulating medium having a first light modulating state in response to a first electric field applied across the light modulating medium and a second light modulating state in response to a second electric field applied across the light modulating medium, said second light modulating state having a different optical response from the optical response of said first light modulating state, for producing modulated light having gray scale during a given period of time, a pixel comprising:

(a) a reference signal receiving arrangement for receiving a reference signal that varies in a predetermined way during said given period of time;

(b) an analog pixel image signal receiving arrangement for receiving an analog pixel image signal, the analog pixel image signal being a signal representing a desired gray scale level for said pixel during said given period of time;

(c) a comparing arrangement for comparing said reference signal and said analog pixel image signal and for outputting a first or a second switching signal for switching said light modulating medium between said first and said second light modulating states respectively when said reference signal reaches a predetermined level relative to said analog pixel image signal; and (d) a control signal receiving arrangement for receiving a control signal, the control signal being a signal for controlling the operation of the comparing arrangement such that (i) when the control signal is in a first state, the comparing arrangement outputs said first switching signal for switching said light modulating medium to said first light modulating state when said reference signal reaches said predetermined level relative to said analog pixel image signal and (ii) when the control signal is in a second state, the comparing arrangement outputs said second switching signal for switching said light modulating medium to said second light modulating state when said reference reaches said predetermined level relative to said analog pixel image signal.

50. A display system including a liquid crystal spatial light modulator having an array of individually controlled pixels for producing modulated light during a given period of time, each of said pixels comprising:

(a) a receiving arrangement for receiving a pixel image signal representing a desired state for that pixel during the given period of time;

(b) a layer of liquid crystal light modulating medium having a first light modulating state in response to a first electric field applied across the liquid crystal light modulating medium and a second light modulating state in response to a second electric field applied across the liquid crystal light modulating medium, said second light modulating state having a different optical response from the optical response of said first light modulating state; and (c) a pixel controlling arrangement for automatically controlling pixel operation during the given period of time, said pixel controlling arrangement being configured to automatically DC-field balance said liquid crystal light modulating medium during said given period of time without requiring said pixel to receive any additional pixel image signals during said given period of time, the pixel controlling arrangement including an arrangement that inverts the optical appearance of the pixel during a second portion of the frame with respect to the optical appearance of the pixel during a first portion of the frame.

51. A display system according to claim 50 wherein said liquid crystal light modulating medium requires DC-field balancing in order to prevent degradation of the liquid crystal light modulating medium.

52. A display system according to claim 50 wherein each pixel of said array of individually controlled pixels further includes illumination means, said illumination means including a source of light having an ON operating state during which light is directed into the liquid crystal light modulating medium of that pixel and an OFF operating state during which no light from said illumination means reaches the liquid crystal light modulating medium of that pixel, said illumination means cooperating with said pixel controlling arrangement in such a way that, said given period of time being divided into a first and a second equal portion, said source of light is maintained in its ON operating state during said first portion of said given time and the source of light is maintained in its OFF operating state during said second portion of said given time so as to produce modulated light having gray scale during said given period of time while, at the same time, DC-field balancing said liquid crystal light modulating medium.

53. In a display system including a spatial light modulator having an array of individually controlled pixels, each of which pixels includes a light modulating medium having a first light modulating state in response to a first electric field applied across the light modulating medium and a second light modulating state in response to a second electric field applied across the light modulating medium, said first and second electric fields being substantially identical in magnitude but of opposite polarity and said second light modulating state having a different optical response from the optical response of said first light modulating state, for producing modulated light having gray scale during a given period of time, a method of operating the pixels comprising the steps of:

(a) providing a reference signal that varies in a predetermined way during said given period of time;

(b) providing to each pixel an analog pixel image signal that is associated with each pixel for the given period of time, the analog pixel image signal representing a desired gray scale level for each associated pixel during said given period of time;

(c) for each of the pixels, comparing said reference signal and said analog pixel image signal and switching said light modulating medium between said first and said second light modulating states respectively when said reference signal reaches a predetermined level relative to said analog pixel image signal; and (d) providing a control signal for controlling the operation of the pixel such that (i) when the control signal is in a first state, the light modulating medium is switched to said first light modulating state when said reference signal reaches said predetermined level relative to said analog pixel image signal and (ii) when the control signal is in a second state, the light modulating medium is switched to said second light modulating state when the reference reaches said predetermined level relative to said analog pixel image signal.

54. A method of operating a display system including a liquid crystal spatial light modulator having an array of individually controlled pixels, each of which pixels includes a liquid crystal light modulating medium having a first light modulating state in response to a first electric field applied across the liquid crystal light modulating medium and a second light modulating state in response to a second electric field applied across the liquid crystal light modulating medium, said first and second electric fields being substantially identical in magnitude but of opposite polarity and said second light modulating state having a different optical response from the optical response of said first light modulating state, for producing modulated light during a given period of time, the method comprising the steps of:

(a) for each pixel, providing a receiving arrangement for receiving a pixel image signal representing a desired state for each pixel during the given period of time; and (b) for each pixel, providing a pixel controlling arrangement for automatically controlling the operation of the pixel during the given period of time, said pixel controlling arrangement being configured to automatically DC-field balance said liquid crystal light modulating medium during said given period of time without requiring said pixel to receive any additional pixel image signals during said given period of time, the pixel controlling arrangement including an arrangement that inverts the optical appearance of the pixel during a second portion of the frame with respect to the optical appearance of the pixel during a first portion of the frame.

55. A method according to claim 54 wherein said liquid crystal light modulating medium requires DC-field balancing in order to prevent degradation of the liquid crystal light modulating medium.

56. A method according to claim 54 further comprising the steps of:

providing illumination means at each pixel, said illumination means including a source of light having an ON operating state during which light is directed into the light modulating medium of that pixel and an OFF operating state during which no light from said illumination means reaches the light modulating medium of that pixel;

for said given period of time being divided into a first and a second equal portion, maintaining said source of light in its ON operating state during said first portion of said given time; and maintaining said source of light in its OFF operating state during said second portion of said given time so as to produce modulated light having gray scale during said given period of time while, at the same, DC-field balancing said light modulating medium.

* * * * *